US011247140B2

(12) United States Patent
Lemoine et al.

(10) Patent No.: US 11,247,140 B2
(45) Date of Patent: Feb. 15, 2022

(54) SYSTEM AND METHOD FOR MAKING A CRAFT

(71) Applicant: SPIN MASTER LTD., Toronto (CA)

(72) Inventors: Stephanie Lemoine, Toronto (CA); Kyra Crilly, Toronto (CA); Arta Alagheband, Toronto (CA); Samuel Chien Chao Cheng, East York (CA)

(73) Assignee: Spin Master Ltd., Toronto (CA)

( * ) Notice: Subject to any disclaimer, the term of this patent is extended or adjusted under 35 U.S.C. 154(b) by 0 days.

(21) Appl. No.: 16/840,938

(22) Filed: Apr. 6, 2020

(65) Prior Publication Data

US 2020/0230512 A1 Jul. 23, 2020

Related U.S. Application Data

(63) Continuation of application No. 15/350,757, filed on Nov. 14, 2016, now Pat. No. 10,610,798.

(60) Provisional application No. 62/254,514, filed on Nov. 12, 2015.

(51) Int. Cl.
*A63H 33/00* (2006.01)

(52) U.S. Cl.
CPC ..... *A63H 33/001* (2013.01)

(58) Field of Classification Search
CPC ..... B29C 33/48; B29C 33/505; B29C 33/76; B29C 39/26; B29C 41/00; B29C 41/08; B29C 41/14; B29C 41/36; B29C 41/38; B29C 41/42; B29C 43/50; B29C 2043/5007; B29C 45/4421; B29C 31/002; B29C 33/0016; B29C 53/42; B29C 53/50; B29C 53/828

See application file for complete search history.

(56) References Cited

U.S. PATENT DOCUMENTS

| | | | | |
|---|---|---|---|---|
| 2,718,583 | A | 9/1955 | Noland et al. | |
| 8,945,455 | B2 | 2/2015 | Everhart et al. | |
| 2006/0145369 | A1* | 7/2006 | Lawton | B29C 33/306 264/1.32 |
| 2015/0367545 | A1* | 12/2015 | Berg | B29C 45/4421 428/36.9 |

FOREIGN PATENT DOCUMENTS

| | | | |
|---|---|---|---|
| EP | 0756926 | * | 7/1996 |

* cited by examiner

*Primary Examiner* — Stella K Yi
(74) *Attorney, Agent, or Firm* — Millman IP Inc.

(57) ABSTRACT

A system for making a craft comprises a core and a sleeve. The core includes a molding portion. The sleeve has an exterior surface and defines an interior space. The sleeve comprises a collapsible portion that is collapsible towards the interior space. The sleeve is configured to cover the molding portion such that the molding portion of the core prevents collapsing of the collapsible portion interiorly. The core is configured to be releasable from the sleeve and when there is a layer of dried molding material on the exterior surface, the collapsible portion of the sleeve is articulable interiorly away from the layer of dried molding material to at least partially collapse the sleeve for removal from the layer of dried molding material.

10 Claims, 19 Drawing Sheets

SYSTEM AND METHOD FOR MAKING A CRAFT

CROSS-REFERENCE TO RELATED APPLICATIONS

This application is a continuation of U.S. patent application Ser. No. 15/350,757, which claims the benefit of U.S. Provisional Patent Application No. 62/254,514, filed on Nov. 12, 2015, the contents of both which are incorporated herein by reference in their entirety.

FIELD

The specification relates generally to making crafts, and specifically to a system and method for making a craft.

BACKGROUND OF THE DISCLOSURE

Making crafts, particularly pottery or sculpting, can be messy and difficult for those with limited dexterity, like children. Many conventional pottery systems involve multiple components that can be difficult to operate and require a considerable amount of manipulation of the molding material to create even simple items, such as cups or vases.

It would be desirable to have a system and method for making a craft that may overcome at least some of these problems with conventional pottery and sculpting systems.

SUMMARY OF THE DISCLOSURE

Described herein are various embodiments of a system and method of making a craft, such as an item of pottery. According to one set of embodiments, there is a method of making a craft. The method includes, but is not necessarily limited to: providing a core that includes a molding portion; placing a sleeve over the molding portion, the sleeve being configured to be releasable from the core; applying a portion of molding material to the sleeve; after the applying, shaping the portion of molding material on the sleeve to create a craft; at least partially drying the craft; releasing the core from the sleeve without removing the sleeve from the shaped craft; and, releasing the sleeve from the craft.

According to another set of embodiments, there is a system for making a craft. The system includes, but is not necessarily limited to: a core including a molding portion; and, a sleeve having an exterior surface, the sleeve defining an interior space, the sleeve comprising a collapsible portion that is collapsible towards the interior space. The sleeve is configured to cover the molding portion such that the molding portion prevents collapsing of the collapsible portion interiorly. The sleeve is configured to be releasable from the core. When there is a layer of dried molding material on the exterior surface and the core is removed from the sleeve, the collapsible portion is articulable interiorly away from the layer of dried molding material to at least partially collapse the sleeve for removal from the layer of dried molding material.

The collapsible portion can comprise at least a portion of a sidewall of the sleeve. The collapsible portion can be sufficiently flexible to permit articulation interiorly thereof. The collapsible portion can comprise at least one leaf portion about the interior space, wherein each one of the at least one leaf portions is individually articulable interiorly. The system can further comprise a graspable interior feature connected to an interior surface of the sleeve to facilitate separation of the sleeve from a craft.

BRIEF DESCRIPTIONS OF THE DRAWINGS

For a better understanding of the various embodiments described herein and to show more clearly how they may be carried into effect, reference will now be made, by way of example only, to the accompanying drawings in which.

DETAILED DESCRIPTION

Described herein are various embodiments of a system and method of making a craft, such as an item of pottery. In some embodiments, the craft is shaped or molded on an exterior surface of a sleeve. The material and thickness of the sleeve may be uniform in some embodiments, whereas in other embodiments, the material and thickness may vary, thereby defining one or more collapsible portions that may be collapsed towards an interior space of the sleeve. Further, discontinuities in the sleeve can be employed to facilitate the collapsing of the sleeve from the molding material. When a layer of a molding material on the exterior surface is at least partially dry, the collapsible portion(s) can be articulated or moved away from the dried layer and the sleeve can be removed from the shaped craft. The sleeve may be configured to support, on its own, the shaping of the molding material thereon. However, in some embodiments, a core supports the sleeve while the craft is being shaped on the sleeve.

Figures 1A, 1B:
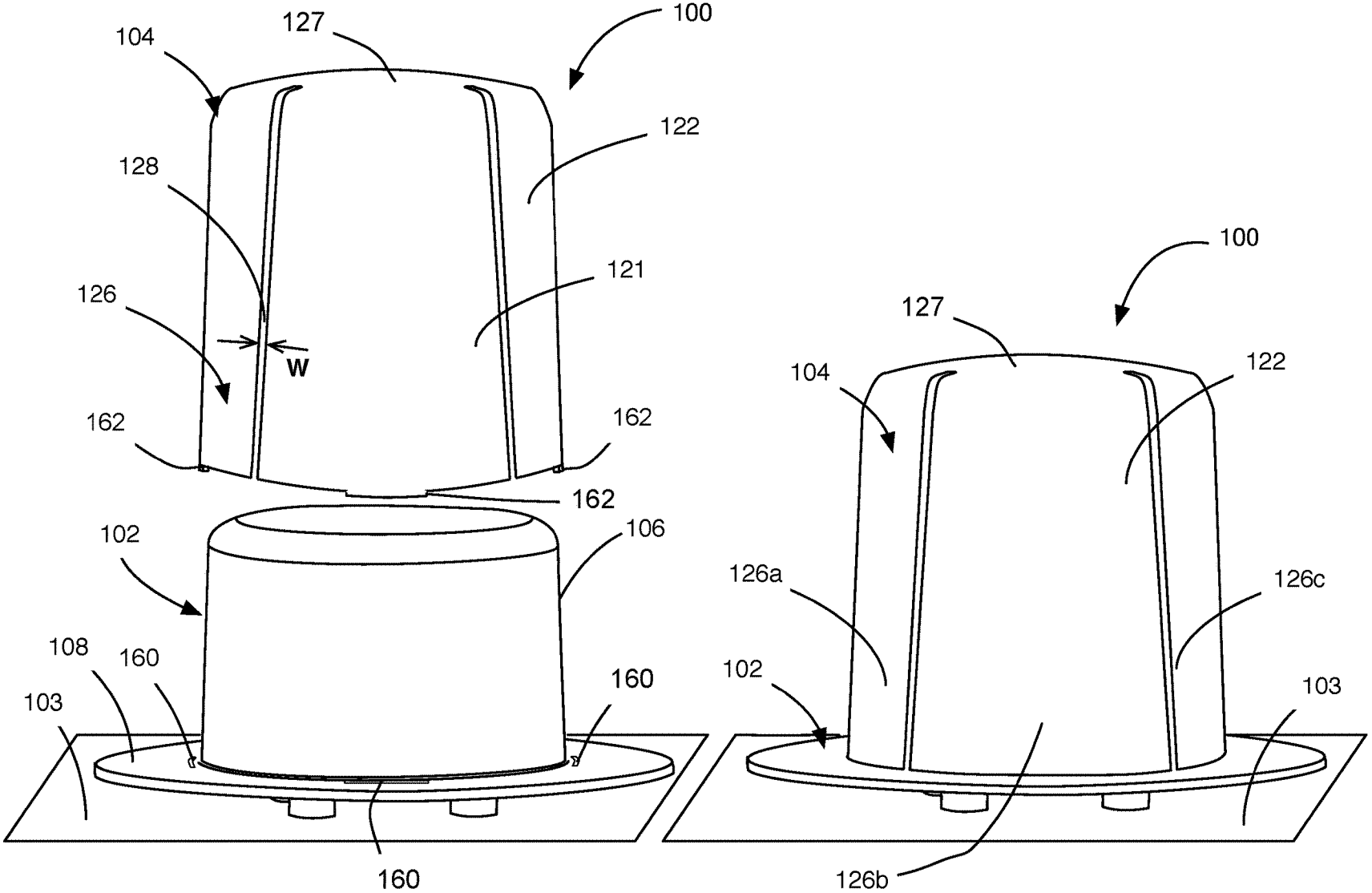
FIG. 1A depicts an exploded view of a system for making a craft, according to an example embodiment.
FIG. 1B depicts the assembled system shown in FIG. 1A.

FIGS. 1A and 1B show an example system 100 for making a craft. FIG. 1A is an exploded view of the system 100 and FIG. 1B shows the system 100 in an assembled configuration. The system 100 includes a core 102 and a sleeve 104. The core 102 includes a molding portion 106 and, in some embodiments, a graspable portion 108 configured to facilitate the removal of the core 102 from the sleeve 104. The graspable portion 108 is configured to be grasped by a user, and may be, for example, a flange, or one or more tabs that extend radially outward from the molding portion 106 of the core 102.

Figure 2B:
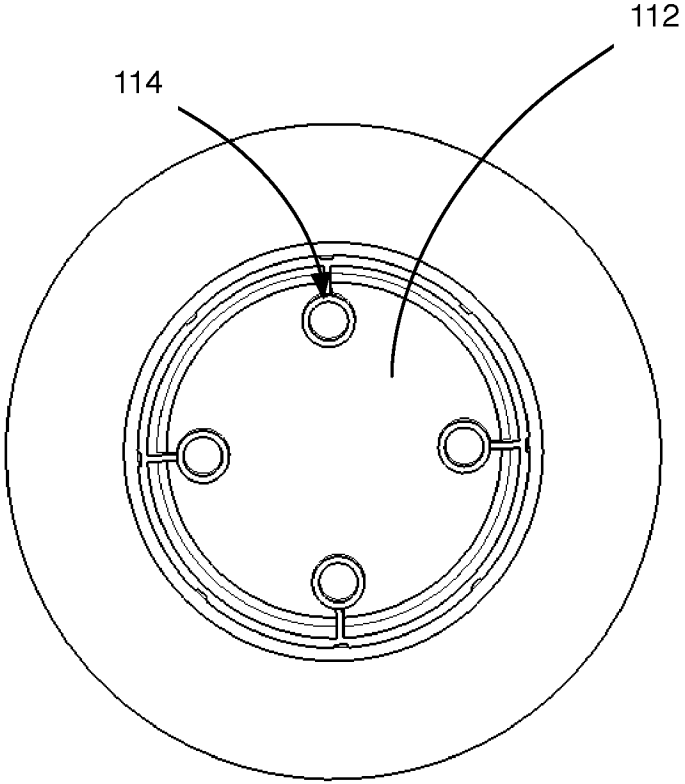
FIG. 2B depicts a bottom elevation view of the core shown in FIG. 2A.
Figure 2A:
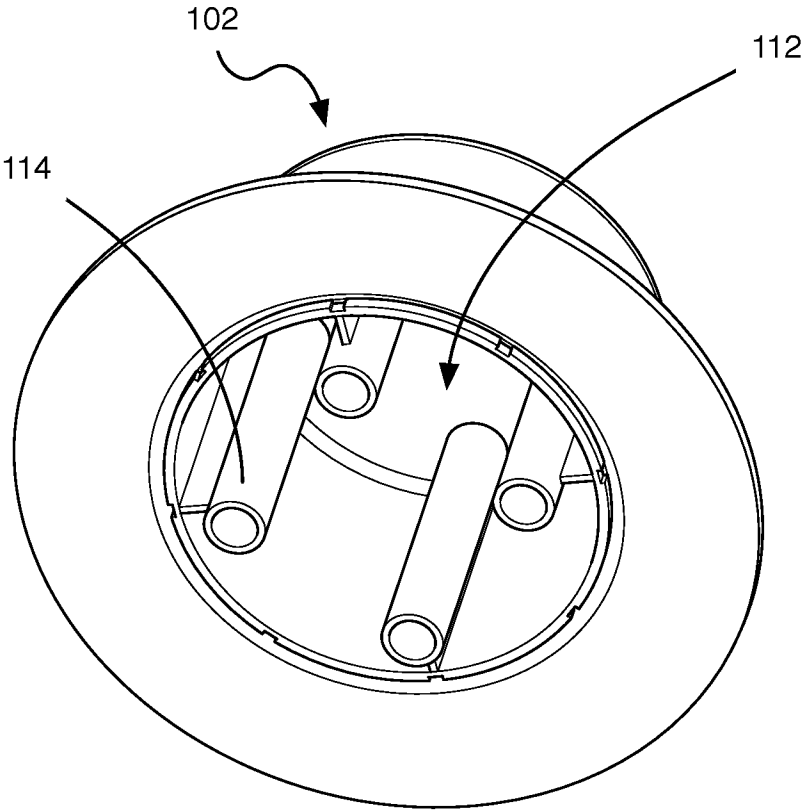
FIG. 2A depicts a rear perspective view of a core of the system for making a craft shown in FIGS. 1A and 1B, according to an example embodiment.

The core 102 provides a supporting structure for the sleeve 104 when the sleeve 104 is placed over the molding portion 104 (FIG. 1B). For example, the core 102 may be generally hollow with an open end 112 and include supports 114 (FIGS. 2A, 2B). However, the core 102 may be a generally solid component. The core 102 can be made from any suitable material or combination of suitable materials, such as plastic, rubber or metal.

Figure 3A:
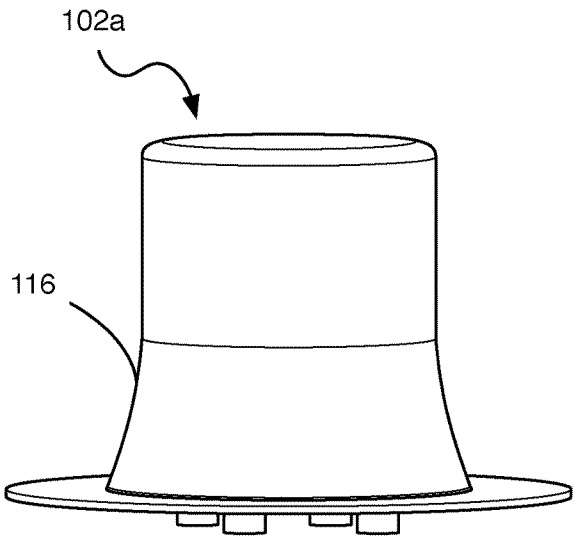
FIGS. 3A to 3D depict a variety of core shapes, according to example embodiments.
Figure 3B:
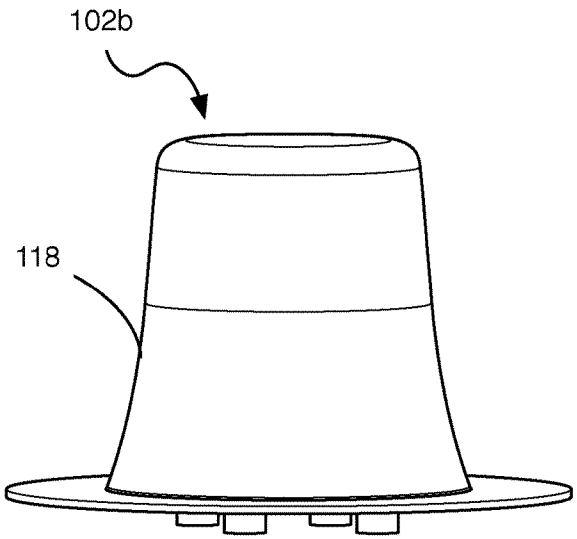
Figure 3C:
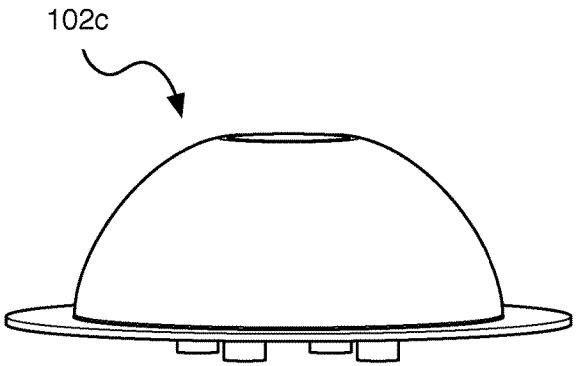
Figure 3D:
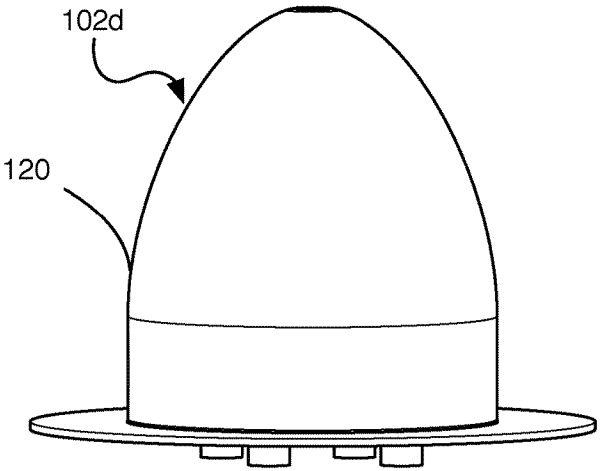

The core 102 can have a variety of shapes and sizes, and may be one of several cores each having a unique shape and/or size. For example, the system 100 can include a core 102*a* (FIG. 3A) that includes a flared portion 116, a core 102*b* (FIG. 3B) that includes a more gradually flared portion 118, a core 102*c* that is dome-shaped and a core 102*d* that includes an egg-shaped portion 120.

The core 102 may be placed on a crafting surface 103. The crafting surface 103 may be a mat of material that grips the core 102 to prevent the core 102 from moving on the crafting surface 103 while the user is making a craft. However, in some embodiments, a crafting surface 103 may be omitted.

Figure 4:
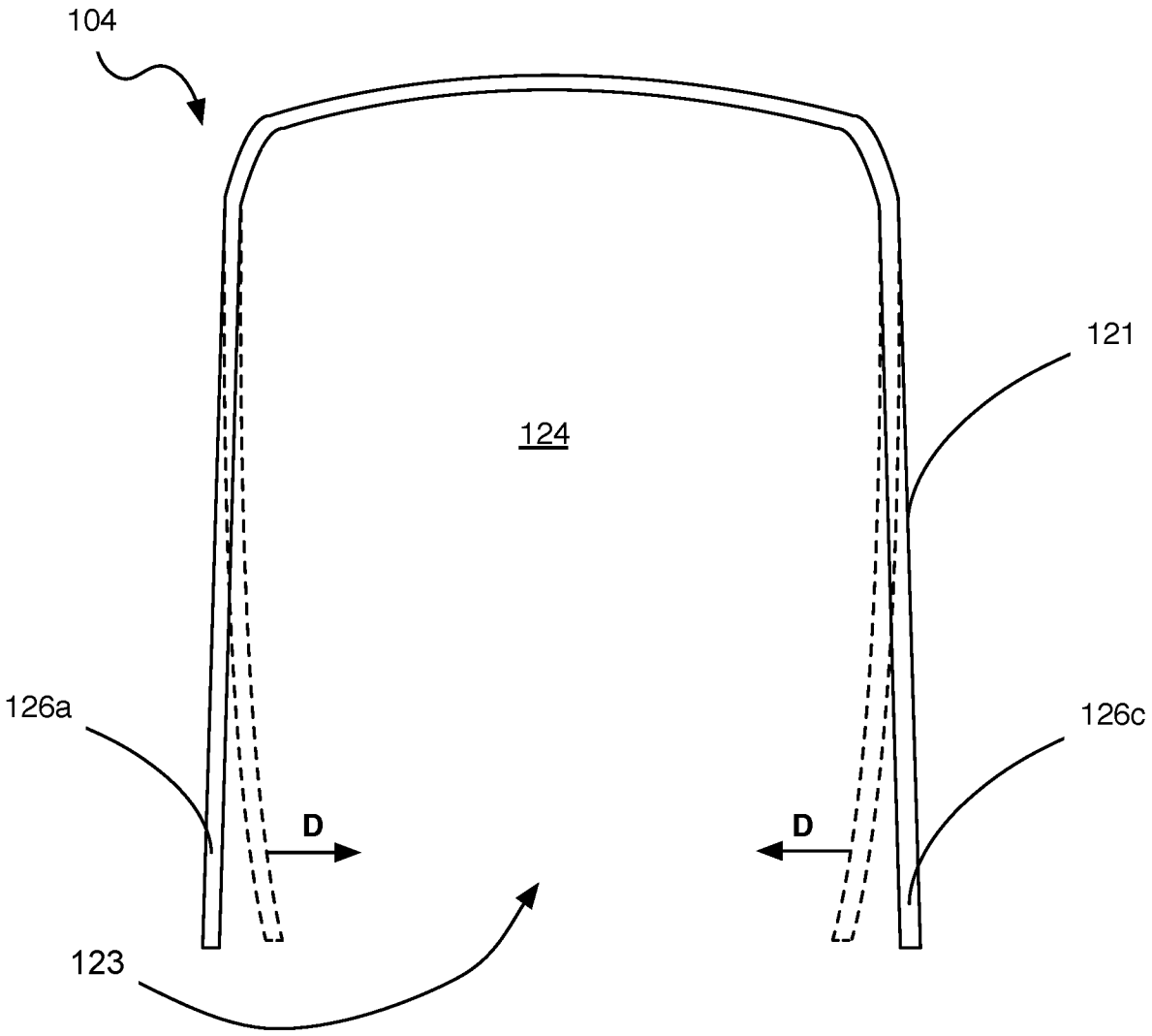
FIG. 4 depicts a cross-section view of a sleeve, according to an example embodiment.
Figure 6:
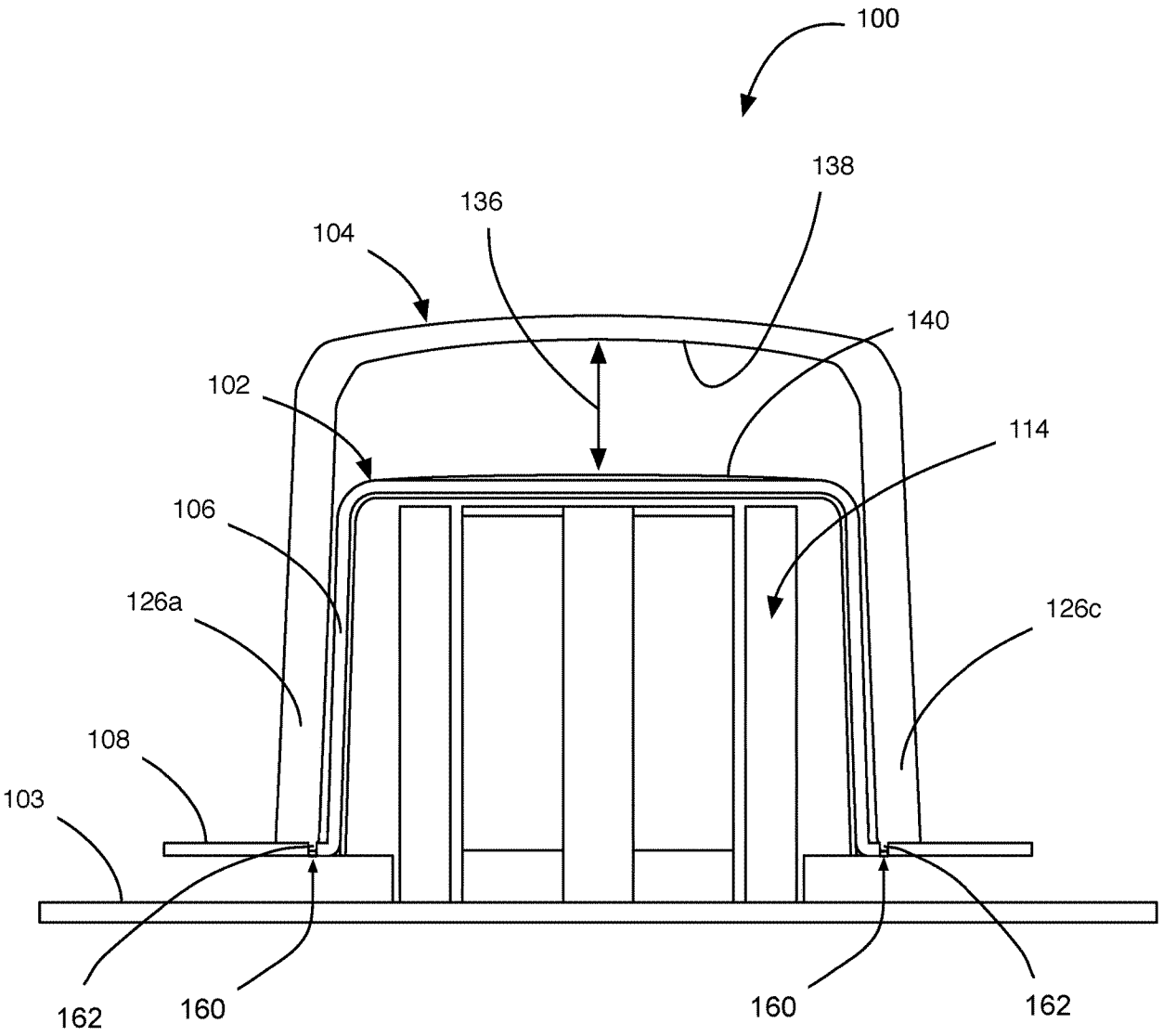
FIG. 6 depicts a cross-section view of the system shown in FIGS. 1A and 1B.

The sleeve 104 includes an exterior surface 122 and defines an interior space 124 (FIG. 4). The sleeve 104 has a sidewall 121 defining an open end 123 (FIG. 4) and is configured to slip over and at least partially cover the molding portion 106 so as to receive the molding portion in the interior space 124 (FIG. 6). For example, the crafting surface 103 may face generally upwards and the open end 123 of the sleeve 104 face generally downwards when the sleeve 104 is on the molding portion 106 and the core 102 is on the crafting surface 103.

Figure 10B:
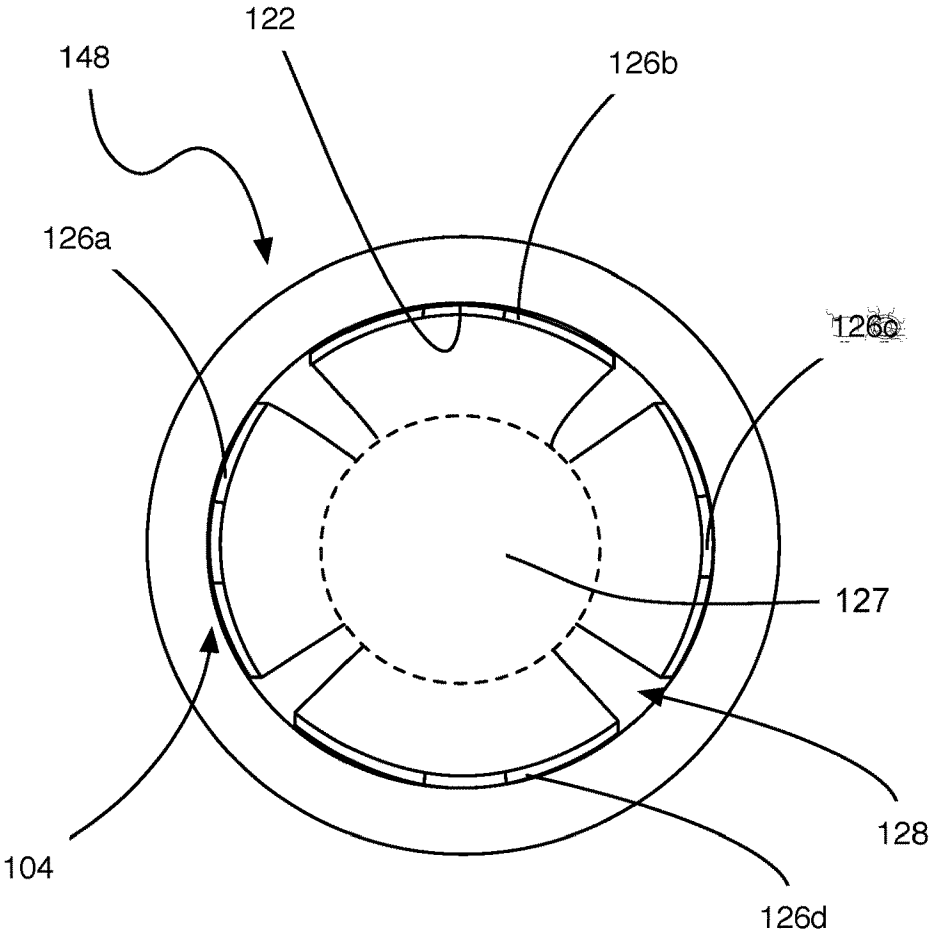
FIG. 10B depicts a bottom elevation view of the shaped craft with the sleeve shown in FIG. 10A.

The sleeve 104 has a collapsible portion that is collapsible towards the interior space. Some or all of the sleeve can be collapsible towards the interior space, or where the interior space was when the sleeve 104 was not collapsed. The collapsible portion can be at least a portion of the sidewall 121. In this particular embodiment, the collapsible portion includes a plurality of leaf portions 126 (individually shown at 126*a*, 126*b*, 126*c* and 126*d* in FIG. 10B) that are connected to a body portion 127. Neighboring leaf portions, such as the leaf portion 126*a* and the leaf portion 126*b*, are separate from one another, and optionally are separated by a discontinuity in the form of a gap 128 of width, W, from one another. Each one of the leaf portions 126 is configured to be individually articulated inwardly towards the interior space 124 (e.g., in the direction, D, as shown for the leaf portions 126*a* and 126*c* by the dashed line representations in FIGS. 4 and 5). For example, the sleeve 104 can be made of a material that is sufficiently flexible and non-stick (for example, thermal plastic rubber, or a silicone material), such that the leaf portions 126 can be bent or folded inwardly towards the interior space 124 and a molding material does not adhere to the sleeve 104.

In some embodiments, there is a hinge line 132 in the material of the sleeve 104 at the base of each leaf portion 126 (i.e., between each leaf portion 126 and the body 127 that allows the leaf portions 126 to flex interiorly.

As stated above, the sleeve 104 is configured to at least partially cover the molding portion 106 such that the molding portion 106 prevents collapsing of the collapsible portion (i.e., the leaf portions 126 in this embodiment) interiorly (e.g., in the direction, D, towards the interior space 124). Although the sleeve 104 is sized to at least partially cover the molding portion 106, the sleeve 104 may be sized larger than the molding portion 106 such that there is a space 136 (FIG. 6) between an inner surface 138 of the sleeve 104 and an exterior surface 140 of the molding portion 106. In some embodiments, the sleeve 104 is made from a material that is sufficiently rigid to support a portion of molding material 142 (FIG. 7) and to generally retain the space 136 (i.e., while substantially preventing any collapse of the space 136). The portion of molding material 142 may be any molding material suitable for making the craft, such as air dry modeling clay.

Figure 7:
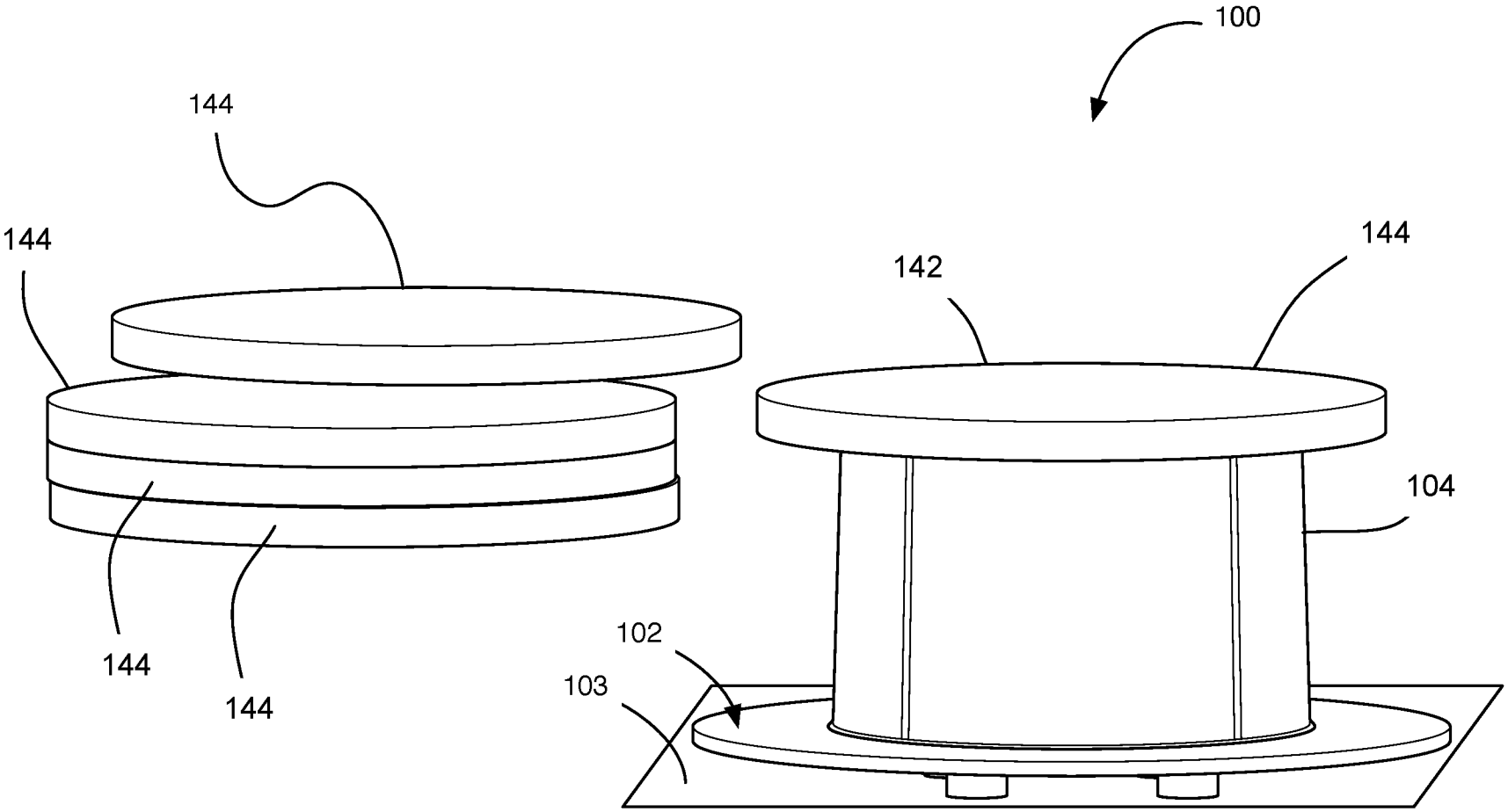
FIG. 7 depicts the system shown in FIGS. 1A and 1B including a portion of molding material applied to the exterior surface of the sleeve, according to an example embodiment.
Figure 8:
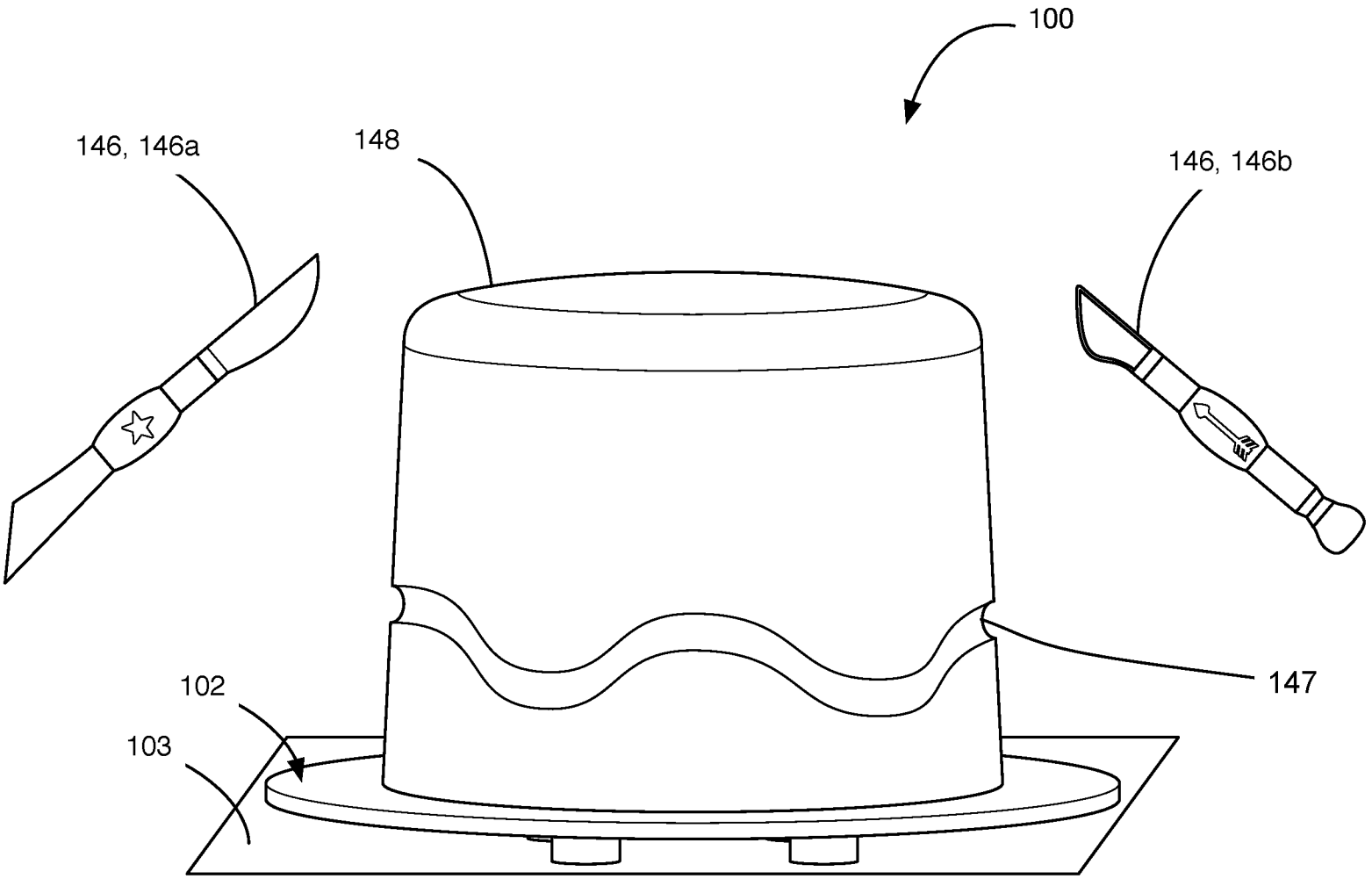
FIG. 8 depicts the shaping of the portion of molding material of FIG. 7, according to an example embodiment.

Referring to FIGS. 7 and 8, in making the craft, the portion of molding material 142 is applied to the exterior surface 122 of the sleeve 104. In some embodiments, the portion of molding material is a pre-formed disk of molding material 144. The portion of molding material 142 is then shaped on the exterior surface 122. In some embodiments, the system 100 includes at least one tool 146 configured to be used to modify the shape of the portion of molding material 142 while the portion of molding material 142 is on the exterior surface 122 (FIG. 8). Examples of tools that may be provided include a knife tool 146*a* and/or a scoop tool 146*b*. An example of a modification that the tool 146 can be used for is shown at 147. The modification 147 shown in FIG. 8 is a generally undulating groove that is formed about the circumference of the shaped portion of molding material.

Figure 9:
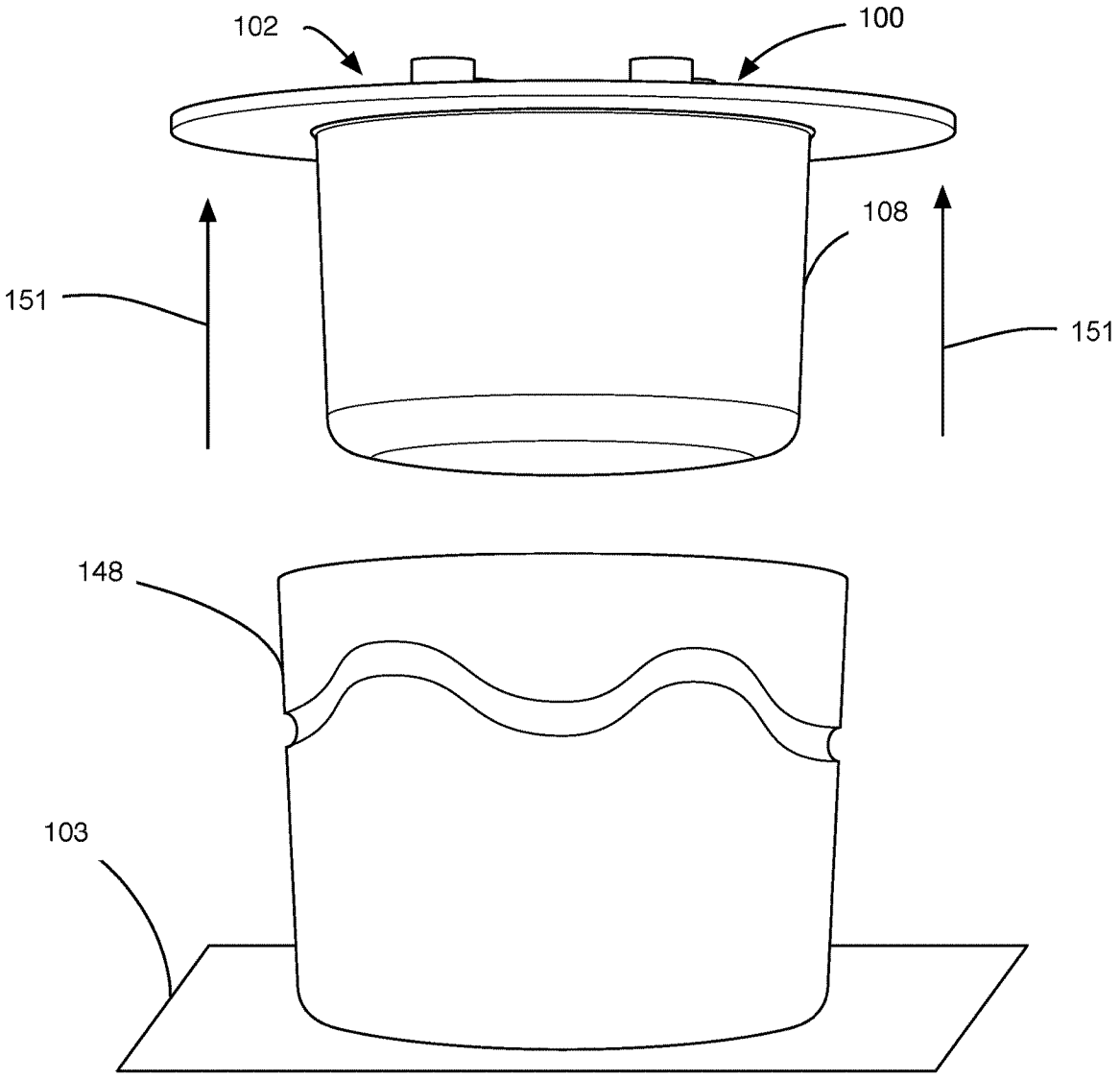
FIG. 9 depicts the removal of the core from the sleeve and shaped craft, according to an example embodiment.

The sleeve 104 is configured to be releasable from the core 102. As a result, after shaping the portion of molding material 142 to form a craft 148, the sleeve 104, along with the craft 148, is released from the core 102 (FIG. 9). For example, the sleeve 104 may be made of a material that does not adhere to the core 102, such as a suitable silicone. A coating may also be applied to the inner surface 138 of the sleeve 104 that inhibits the sleeve 104 from adhering to the exterior surface 140 of the molding portion 106. As shown in FIG. 9, to release the sleeve 104 (with the craft 148) from the core 102, the core 102, sleeve 104 and craft 148 can be removed from the crafting surface 103 and rotated or re-oriented such that the open end 123 of the sleeve 104 is facing upwards. The core 102 can then easily be lifted out of the sleeve 10. In some embodiments, the core 102 is lifted out of the sleeve 104 using the graspable portion 108.

Figure 10A:
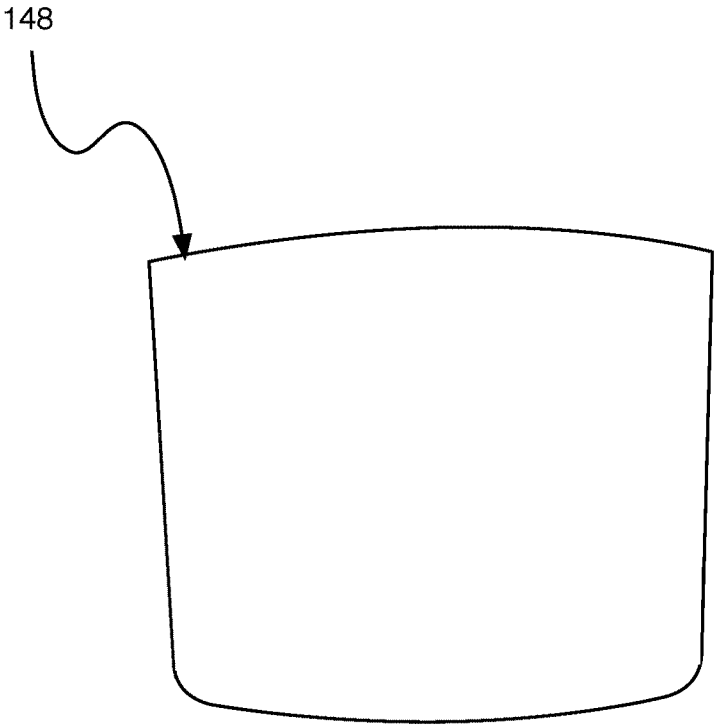
FIG. 10A depicts a front elevation view of the shaped craft with the sleeve after removal of the core in FIG. 9.

The craft 148 is allowed to at least partially dry on the sleeve 104 (FIG. 10A). For example, if the molding material is air-dry modeling clay, the craft 148 could be exposed to air for a sufficient period of time to dry at least partially.

Figure 11B:
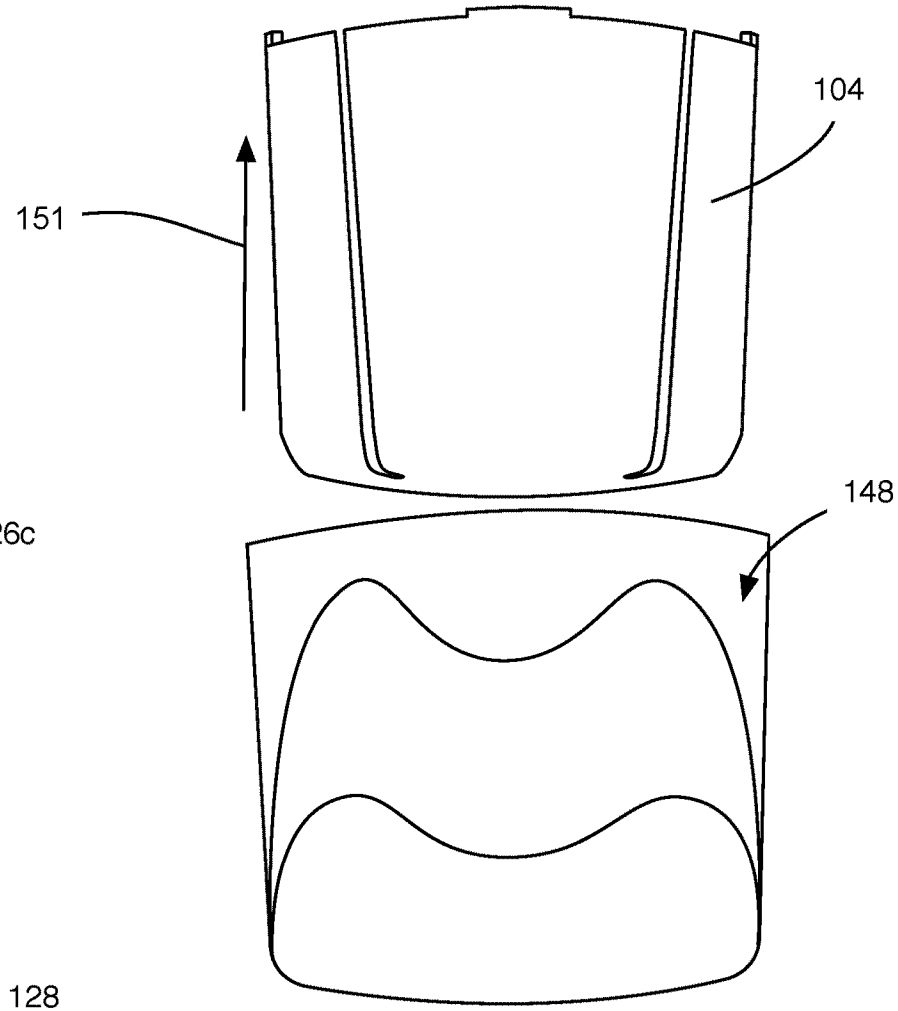
FIG. 11B depicts the removal of the sleeve from the shaped craft, according to an example embodiment.
Figure 11A:
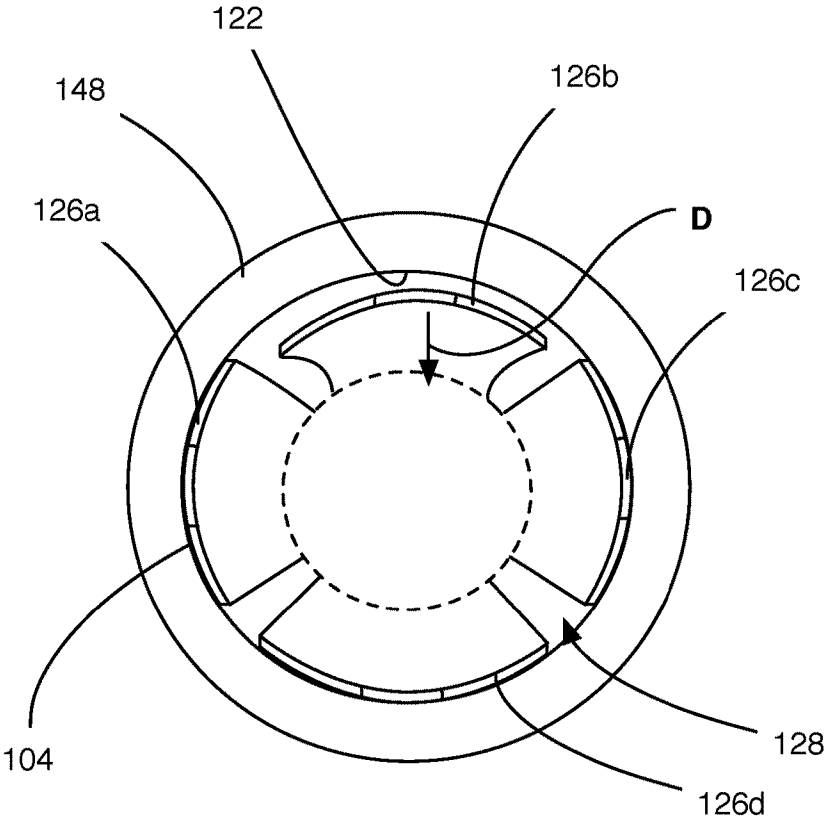
FIG. 11A depicts the articulating of a single leaf portion of the sleeve away from a layer of dried molding material, according to an example embodiment.

When the craft 148 is sufficiently dry, the craft 148 may be separated from the sleeve 104 (i.e., the sleeve 104 may be removed from the craft 148). It will be noted that the craft 148 need not be fully dry in order to be successfully separated from the sleeve 104. For example, the craft 148 may be partially dry, but may be sufficiently dry to be sufficiently strong to permit the leaf portions 126 to be articulated interiorly without causing deformation of the craft 148. The articulation of one of the leaf portions 126 interiorly is shown in FIG. 11A. It will be noted that the material thickness of the sleeve 104 has been exaggerated in FIG. 11A for ease of illustration of the event taking place in the figure.

Articulating each of the leaf portions 126 interiorly away from the craft 148 (FIG. 11A) at least partially collapses the sleeve 104 so as to separate the sleeve 104 from the associated portion of the craft 148. Once a sufficient amount of the sleeve 104 has been separated from the craft 148, the sleeve 104 can be removed from the craft 148 (FIG. 11B). To facilitate the removal of the sleeve 104 from the craft 148, the exterior surface 122 the sleeve 104 can be configured not to adhere to the craft 148. For example, a coating may be applied to the exterior surface 122 of the sleeve 104 or the sleeve 104 may be made from a material that does not adhere the layer 150.

Figure 11C:
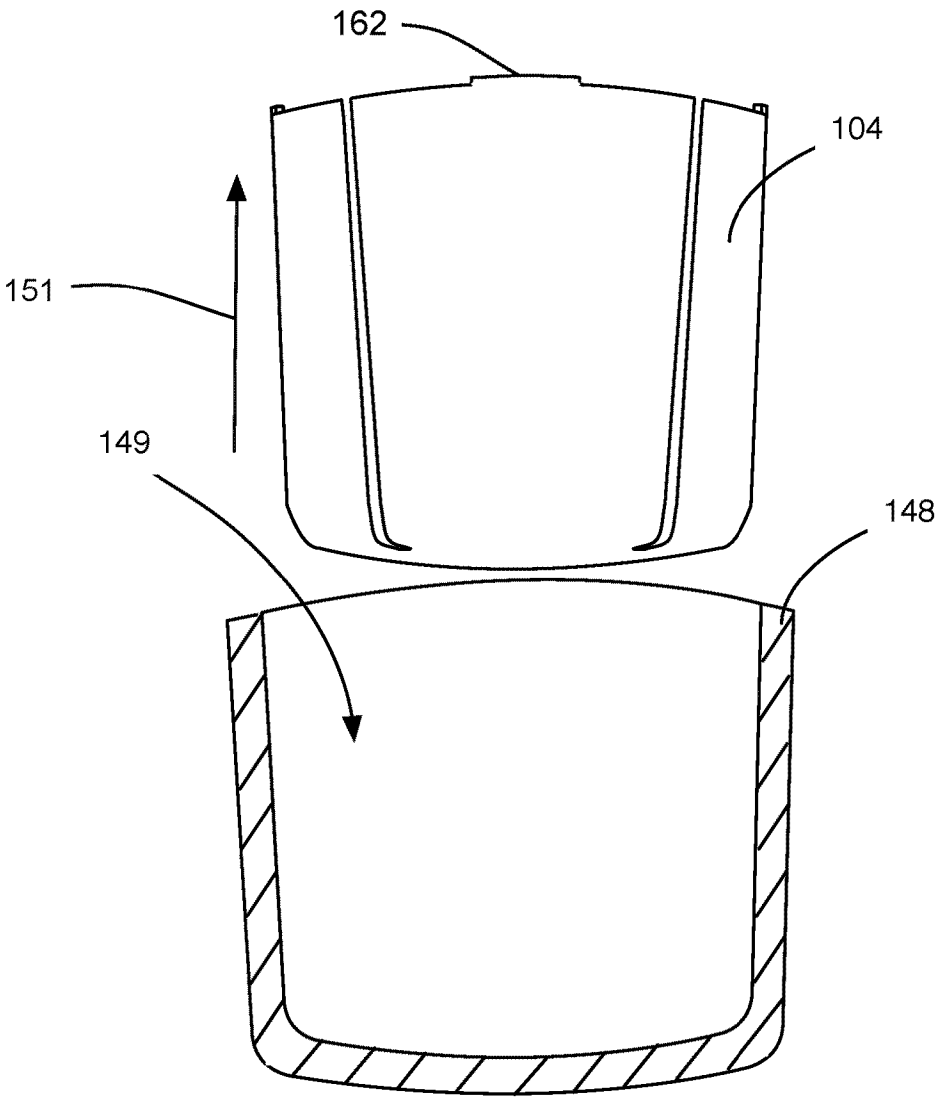
FIG. 11C depicts an interior space of the shaped craft that is revealed when the sleeve is removed from the shaped craft, according to an example embodiment.

FIG. 11C illustrates the removal of the sleeve 104 from the craft 148 (represented by the arrow shown at 151). It will be understood that the sleeve 104 is used to form an interior space 149 of the craft 148. In conventional pottery, creating the interior space of a craft is carried out manually by creating a depression in a portion of molding material and use of one's hand inside the depression against the inner wall of the molding material to form the interior space of the craft. It can be generally difficult and time consuming for those with limited dexterity, such as children.

To facilitate shaping of the craft, the system 100 can optionally further include a turntable 152 (FIG. 12A) that is rotationally supported on a turntable base 158. The turntable 152 has an upper surface that is the crafting surface 103.

Figure 12B:
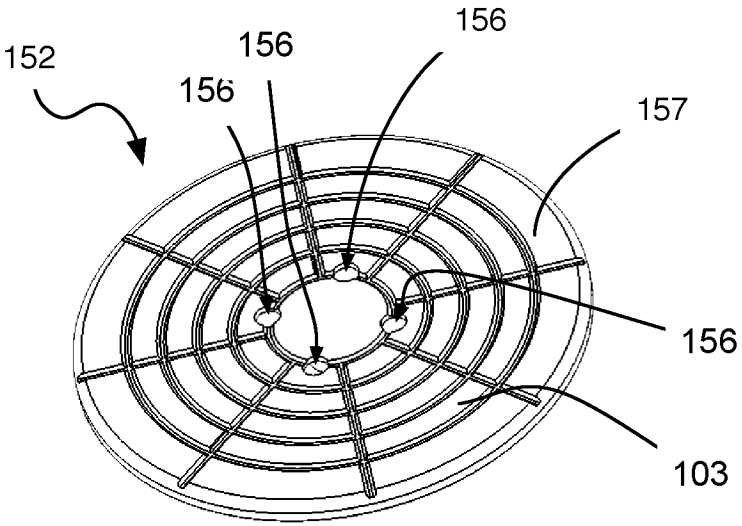
FIG. 12B depicts the turntable of FIG. 12B in isolation.
Figure 12A:
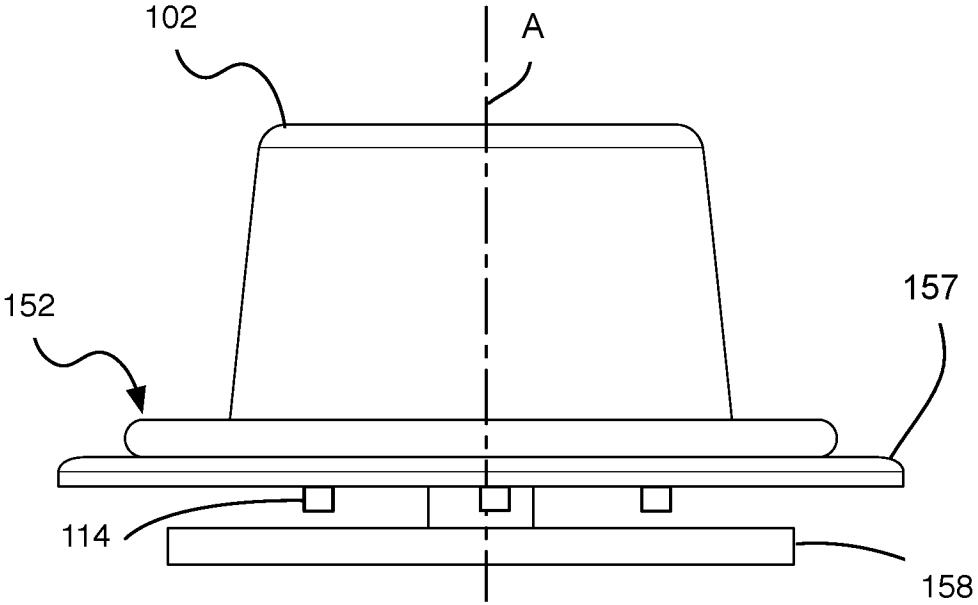
FIG. 12A depicts a core coupled to a turntable, according to an example embodiment.

The turntable 152 may be operated in any suitable way. The example turntable 152 shown in FIG. 12A is operated manually (i.e., it is turned by hand by the user making the craft). The core 102 is configured to rotationally couple to the turntable 152 such that the core 102 rotates with the turntable 152. For example, in some embodiments, the turntable 152 includes core locking apertures 156 (FIG. 12B) that are sized to receive the supports 114 of the core 102. In the embodiment shown, the core 102 is removably rotationally couplable to the turntable 152, such that the core 102 is removable from the turntable 152. Additionally, the supports 114 can be made longer to extend through and beyond the turntable 152, so that, when the core 102 and the turntable 152 are placed on a flat surface resting upon the supports 114, the turntable 152 can be pushed towards the flat surface to disengage the turntable 152 from the supports 114 of the core 102.

Figure 5:
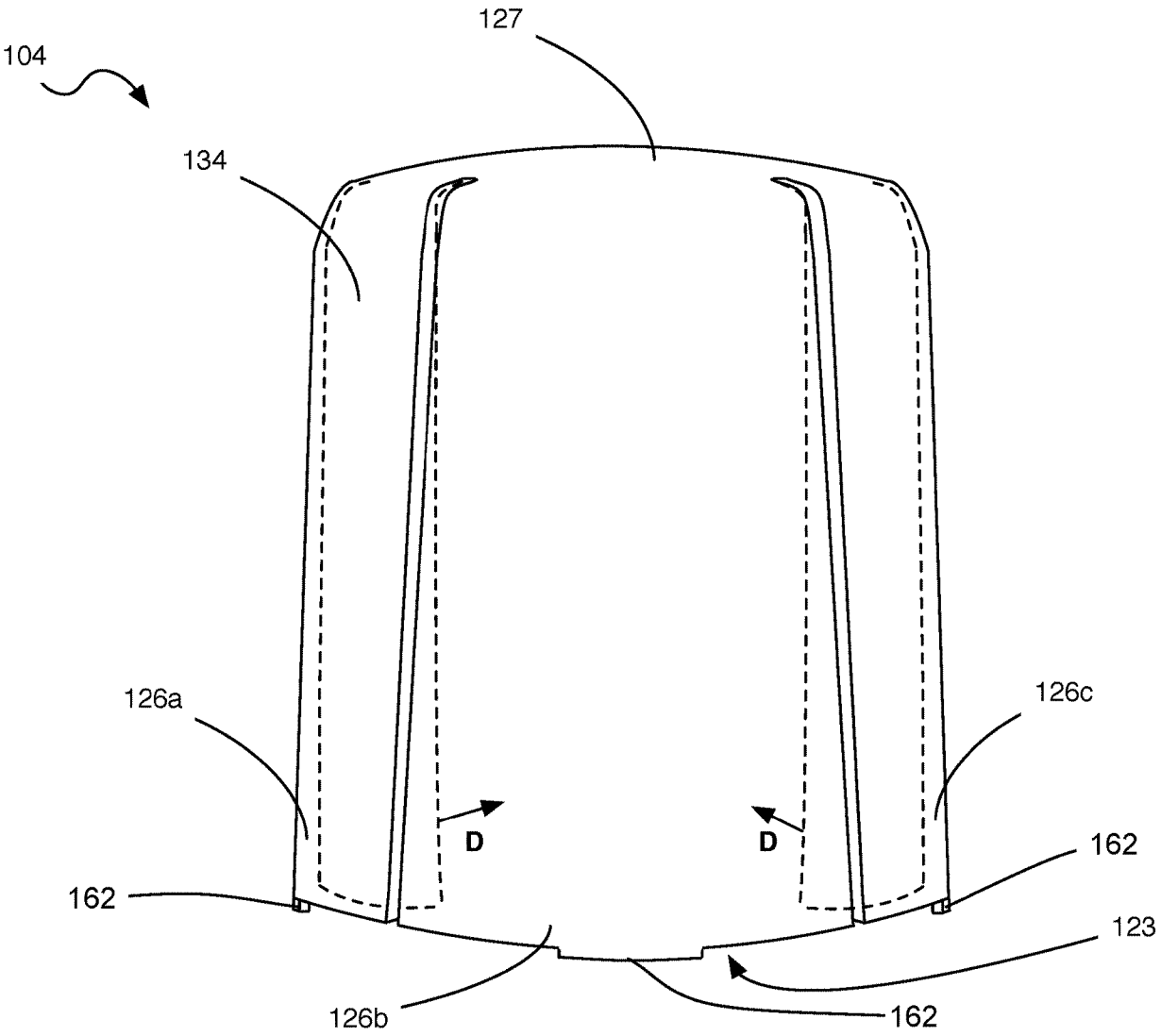
FIG. 5 depicts a front elevation view of the sleeve shown in FIG. 4.

The sleeve 104 is rotationally couplable to the core 102, such that the sleeve 104 rotates with the core 102. In order to rotationally couple the sleeve 104 to the core 102, the core 102 may have sleeve locking apertures 160 that receive locking projections 162 on the sleeve 104. The projections 162 and the apertures 160 are shown in FIGS. 1A, 5 and 6. Alternatively, any other suitable arrangement for rotationally coupling the sleeve 104 with the core 102 may be provided. For example, projections could be provided on the core 102 that mate with apertures in the sleeve 104. In another example, the sleeve 104 could be rotationally coupled to the turntable 152, and, as shown in FIG. 12A, the core 102 could be rotationally coupled to the turntable 152. As a result, the sleeve 104 may be considered to be rotationally coupled to the core 102.

Figure 13:
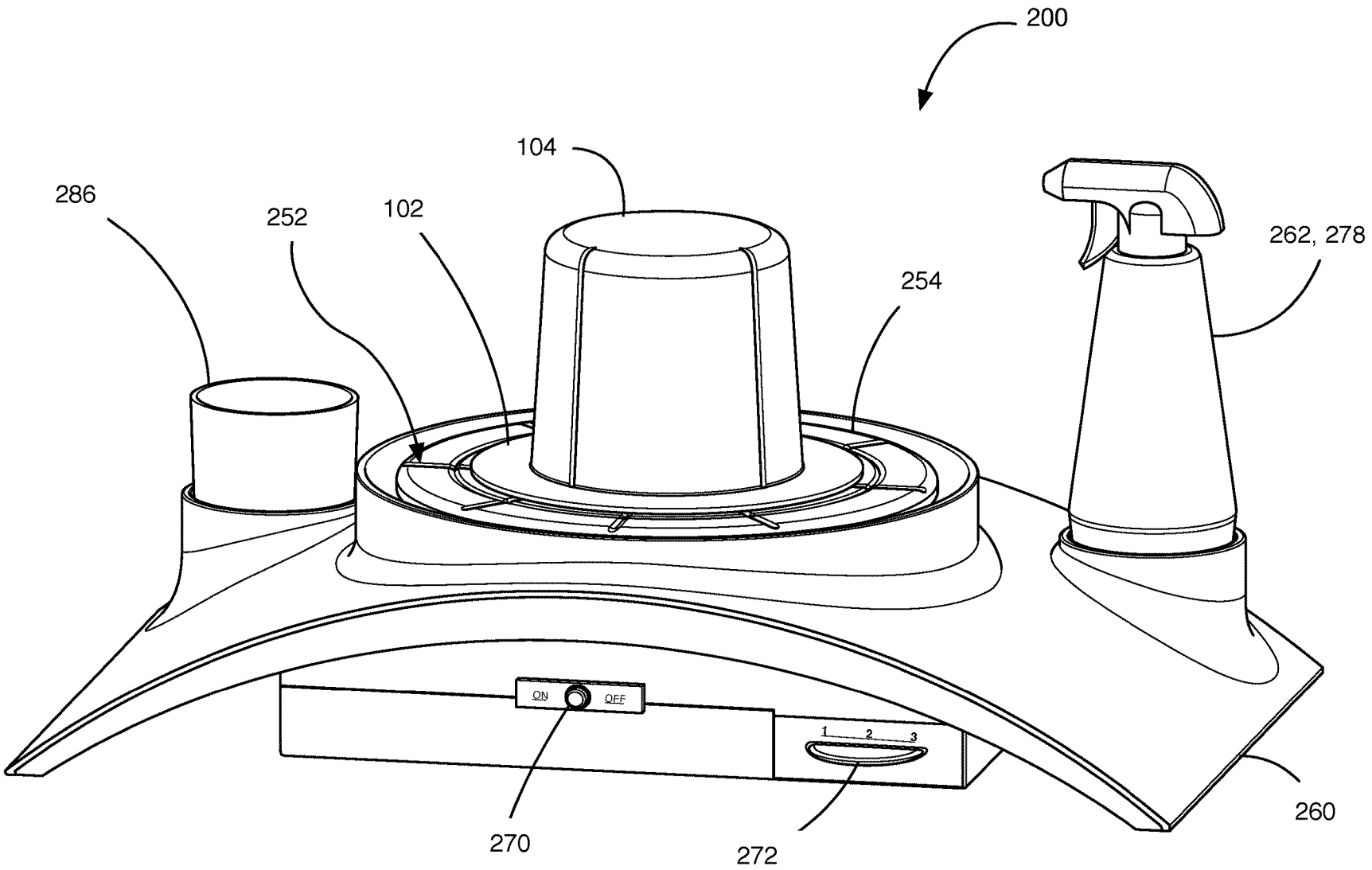
FIG. 13 depicts a system for making a craft, according to a second example embodiment.
Figure 14:
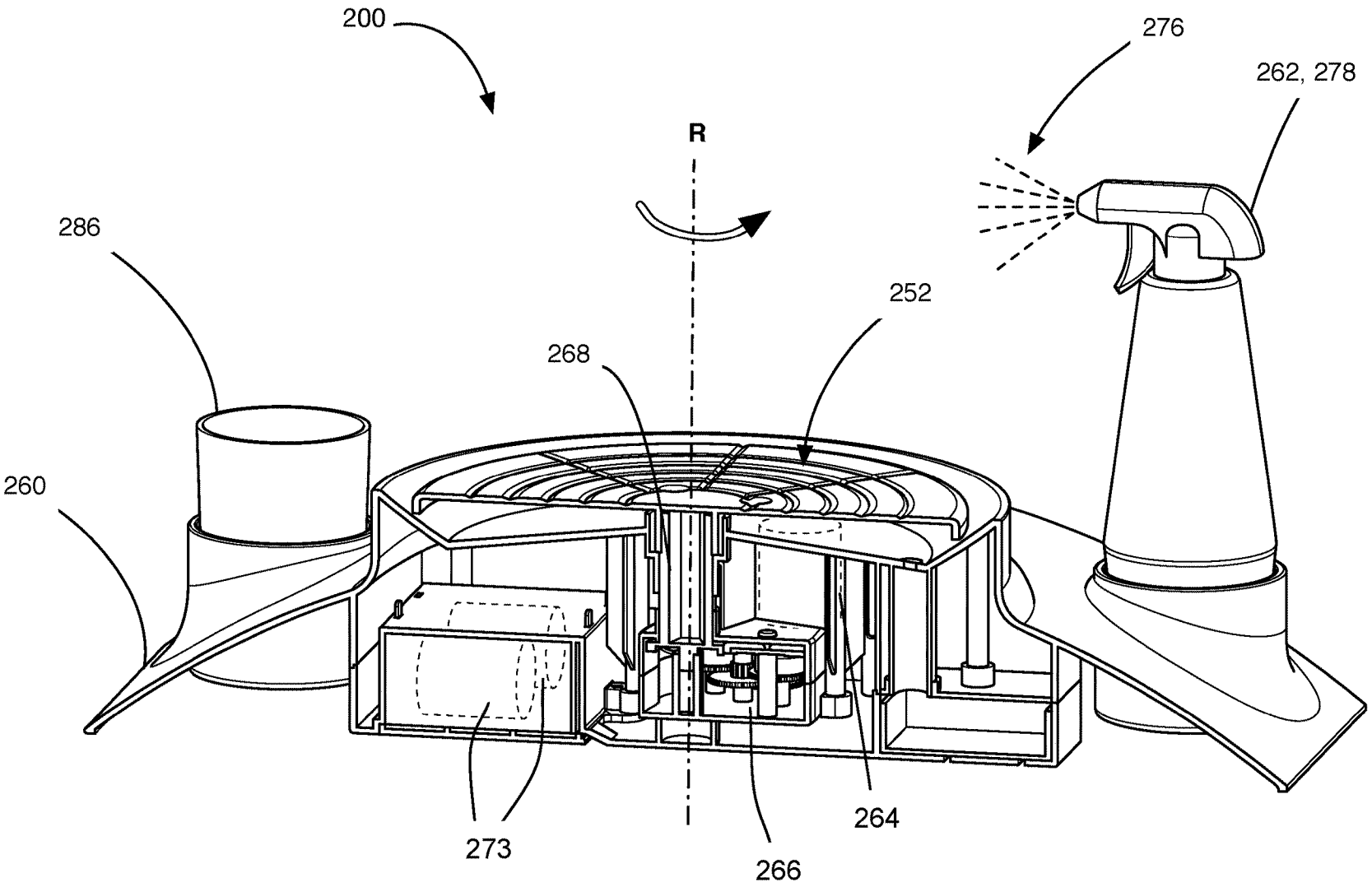
FIG. 14 depicts a cross-section view of the system for making a craft shown in FIG. 13, without the core and the sleeve.

FIGS. 13 and 14 depict another example system 200 for making a craft, in which like or similar elements depicted in FIGS. 1 to 12B are identified with like or similar reference numbers. In addition to the core 102 and the sleeve 104, the system 200 includes a motorized turntable 252 that is rotatably supported on a turntable base 260.

With reference to FIG. 14, a motor 264 is operatively connected to the turntable 252 and is configured to rotate the turntable 252 about an axis of rotation, A. In the example shown in FIG. 14, the motor 264 is operatively connected to the turntable 252 via a geartrain 266 that to a turntable shaft 268 to transmit rotary power from the motor 264 to the turntable shaft 268. In some embodiments, the motor 264 is actuated by an ON/OFF button 270 (FIG. 13). In some embodiments, the motor 264 is configured to rotate the motorized turntable 252 at a plurality of selected speeds. For example, the motor 264 can be operatively connected to a dial 272 that allows a user to rotate the motorized turntable 252 at one of three speeds (FIG. 13). The motor 264 may be powered by any suitable power source, such as, for example, batteries 273.

For better organization of the shaping tools 146, the base 260 can include at least one tool holder 286, such as a cup, a channel or a groove that is suitable to hold the shaping tools 146.

During use of the system 200 to create a craft, the portion of molding material may begin to dry before the desired shape is reached. Depending on the type molding material being used, it may be possible to re-hydrate the portion of molding material. The system 200 can include a hydration device 262 that is configured to apply a hydrating fluid 276, such as water, to the portion of molding material. For example, the hydration device 262 can be a spray bottle 278 that is configured to hold and deliver the hydrating fluid 276 to the portion of molding material.

Figure 15:
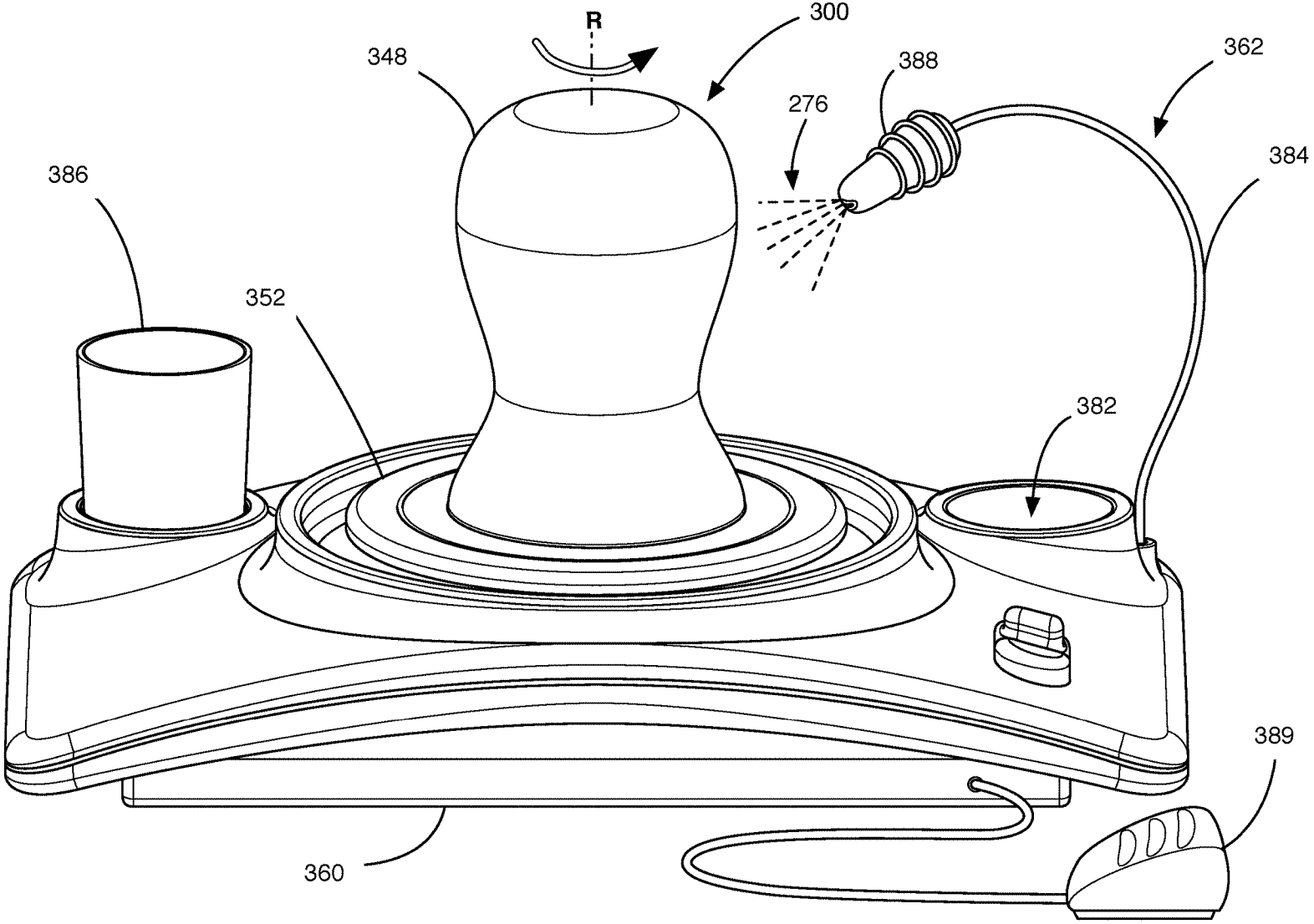
FIG. 15 depicts a system for making a craft, according to a third example embodiment.

FIG. 15 depicts a third example system 300 for making a craft, and in which like or similar elements are given like or similar numbers. The system 300 is similar to the system 200 but has a base 360 that includes a hydration device 362 that includes a reservoir 382 that is optionally removably supported in the base 360 and that is configured to hold the hydrating fluid 276. In some embodiments, the reservoir 382 is refillable by removing the reservoir 382 from the base 360 such that the reservoir 382 can be carried to a source of the hydrating fluid 276 for filling. In other embodiments, the reservoir 382 is integral with the base 360 and is therefore non-removable from the base 360, in which case hydrating fluid can be poured into the reservoir 382 via an aperture in the base 360.

The hydration device 362 has a hand pump nozzle 388 and a hose 384 connected to the reservoir 382 that are configured to draw and deliver the hydrating fluid 276 from the reservoir 382 to a portion of molding material that is being worked on.

The system 300 includes a pedal actuator 389 connected to a motor (not shown) that is configured to rotate the turntable 352 about the axis of rotation, A.

Similar to the system 200, the base 360 can include at least one retaining device 386, such as a cup, a channel or a groove, which is suitable to hold the shaping tools 346.

Figure 16:
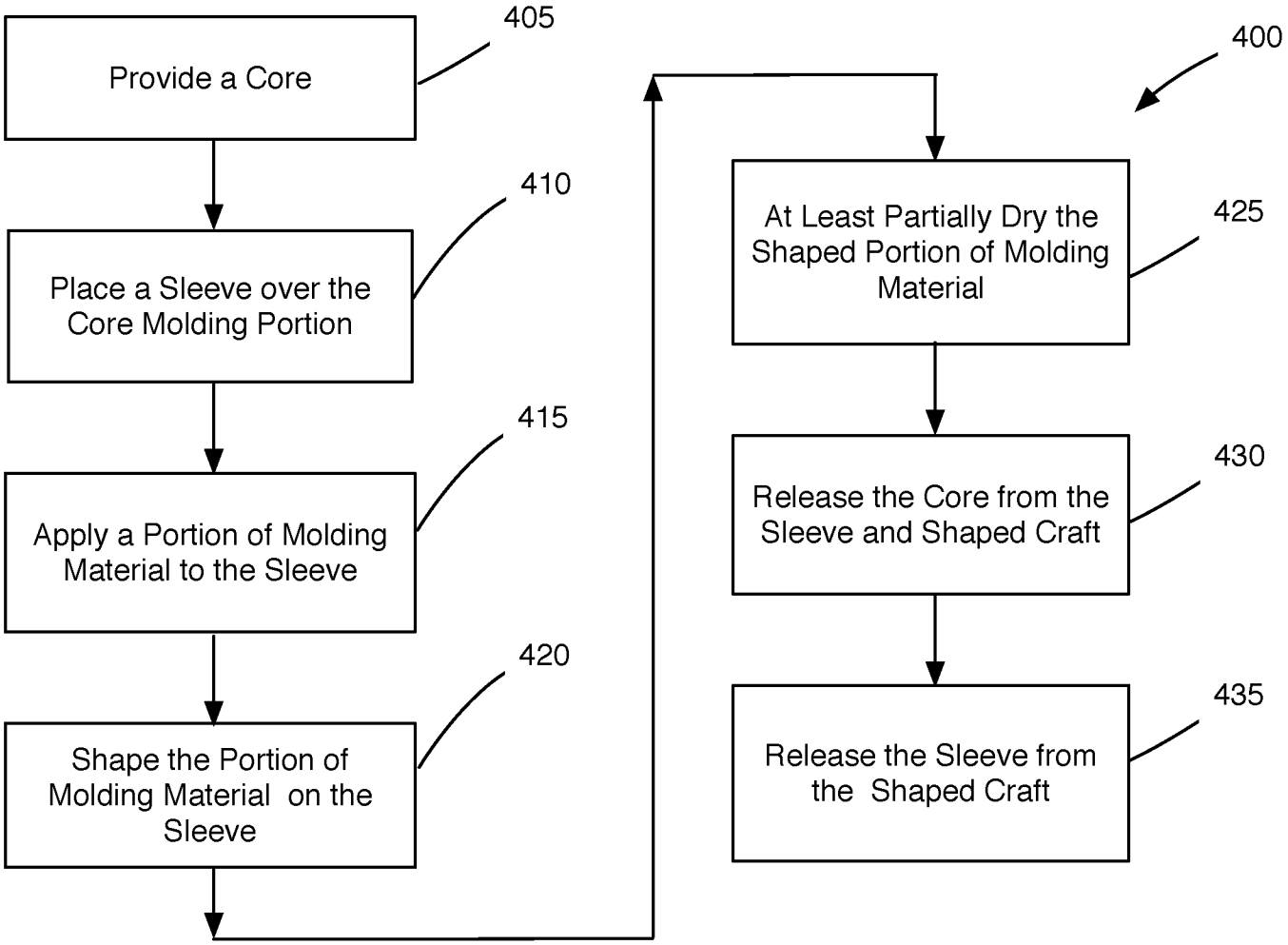
FIG. 16 depicts a method for making a craft, according to an example embodiment.

Attention is now directed to FIG. 16 that depicts an example method 400 for making a craft, such as the craft 148. To aid in the explanation of the method 400, the method 400 will be described as if it is being performed using the systems 100, 200 and 300. However, the method 400 can be varied and need not work exactly as discussed and such variations are within the scope of the appended claims. For example, unless otherwise stated, it is understood that the method 400 need not be performed in the exact sequence shown. Therefore, the elements of the method 400 are referred to as "blocks" rather than "steps". It is also understood that the method 400 can be performed on variations of the systems 100, 200 and 300.

At block 405, a core that includes a molding portion is provided, such as the core 102 having the molding portion 106.

At block 410, a sleeve is placed over the molding portion. For example, the sleeve 104 can be placed over the molding portion 106 such that the sleeve 104 covers at least a portion of the molding portion 106. The sleeve is configured to be releasable from the core. For example, the sleeve 104 may be made of a material that has relatively low frictional engagement with the core 102, such as a suitable silicone material. A coating may also be applied to the inner surface 138 of the sleeve 104 that inhibits the sleeve 104 from adhering to the exterior surface 140 of the molding portion 106.

At block 415, a portion of molding material is applied to the sleeve. For example, the portion of molding material 142 can be applied to the exterior surface 122 of the sleeve 104.

After applying the portion of molding material, at block 420 the portion of molding material is shaped on the sleeve. For example, the shaping tools 146 can be used to carve and otherwise shape the portion of molding material 142 on the exterior surface 122, thereby resulting in a craft 148. The craft 148 is at least partially dried on the sleeve at block 425 to form a craft. For example, the portion of molding material 142 may be an air-dry clay and therefore can be exposed to air for a sufficient amount of time for at least the layer shown at 150 to dry.

At block 430, the core is released from the sleeve and the shaped craft without removing the sleeve from the shaped craft. For example, as shown in FIG. 9, the assembly of the core 102, the sleeve 104 and the shaped craft 148 can be rotated or re-oriented such that the core 102 can be lifted out of the sleeve 104 and the shaped craft 148 (represented by arrows 153).

At block 435, the sleeve is released from the shaped craft. For example, the leaf portions 126 may be individually articulated towards the interior space 124, away from the layer 150 of dried molding material, and at least partially collapsed for removal from the layer 150.

The method 400 may include applying a hydrating fluid, such as the hydrating fluid 276, to the portion of molding material 142. For example, the hydrating fluid 276 can be applied by spraying the hydrating fluid 276 using the spray bottle 278. As another example, the hydrating fluid 276 can be drawn from the reservoir 382 through the hose 384 and delivered to the portion of molding material 142 through the nozzle 388.

Prior to placing the sleeve over the molding portion at block 410, the core may be placed on a crafting surface, such as the crafting surface 103 of the turntable 152, or the crafting surface 103 of the motorized turntable 252. Hence, shaping the portion of molding material 142 at block 420 can include rotating the turntable 252 about the axis of rotation, A. Rotating the turntable 252 can include actuating the motor 264.

Figure 17B:
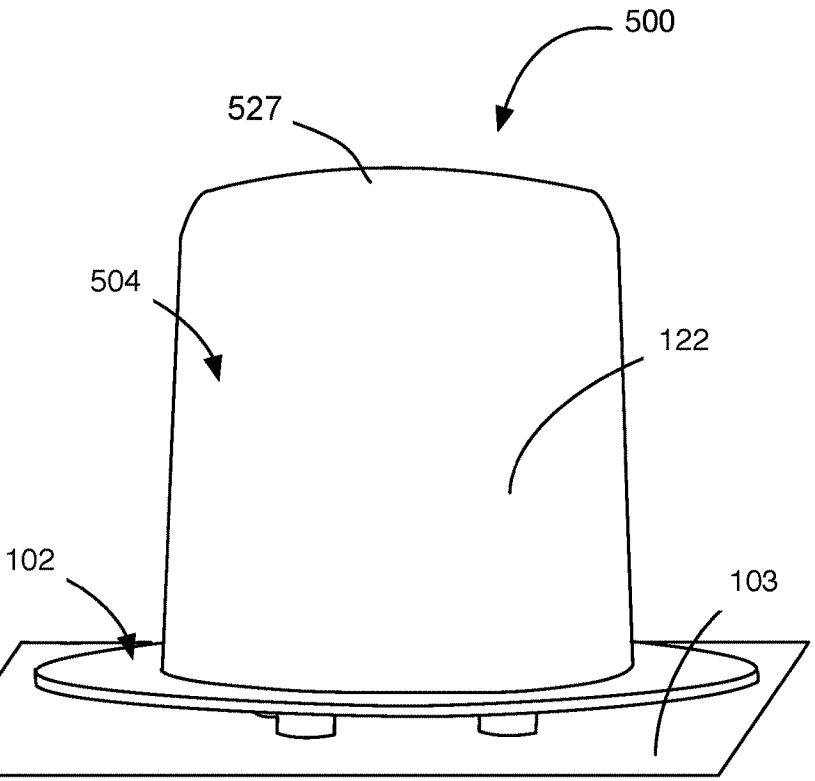
FIG. 17B depicts the assembled system shown in FIG. 17A.
Figure 17A:
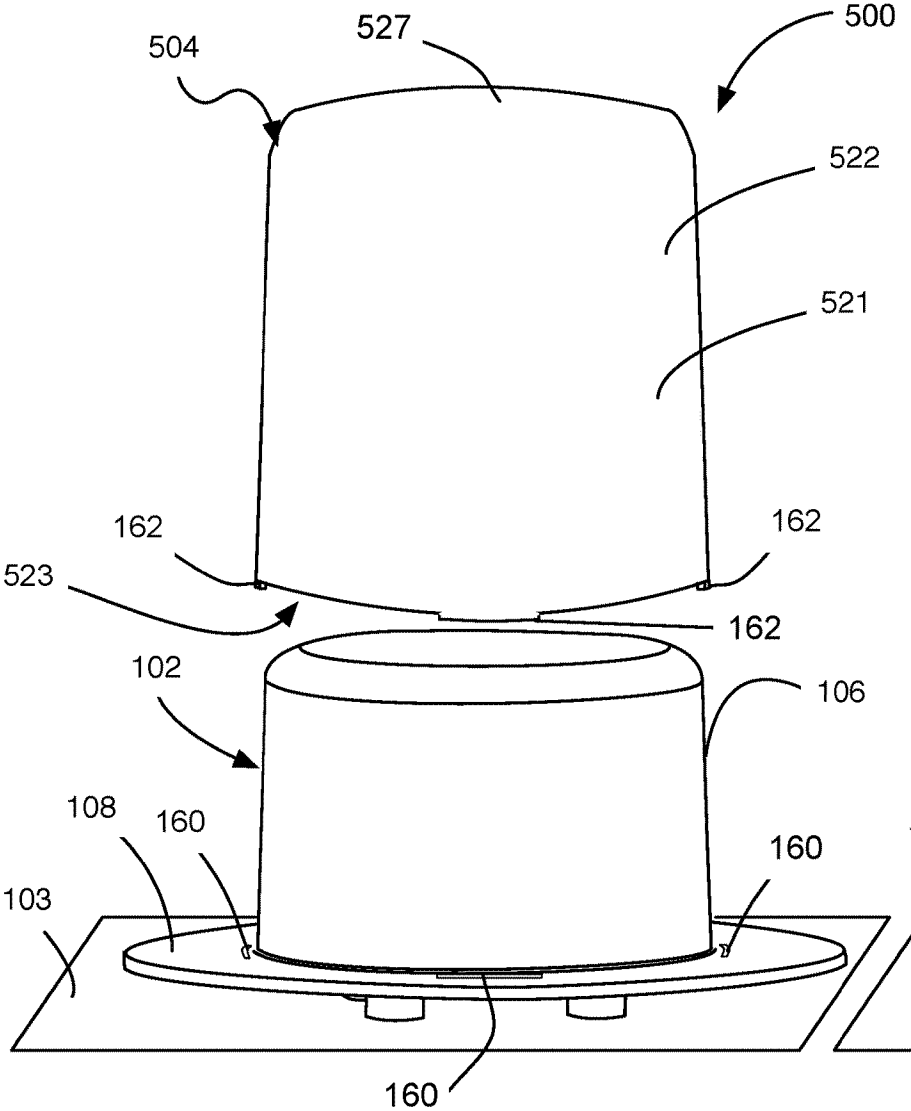
FIG. 17A depicts an exploded view of a system for making a craft, according to an example embodiment.
Figure 17C:
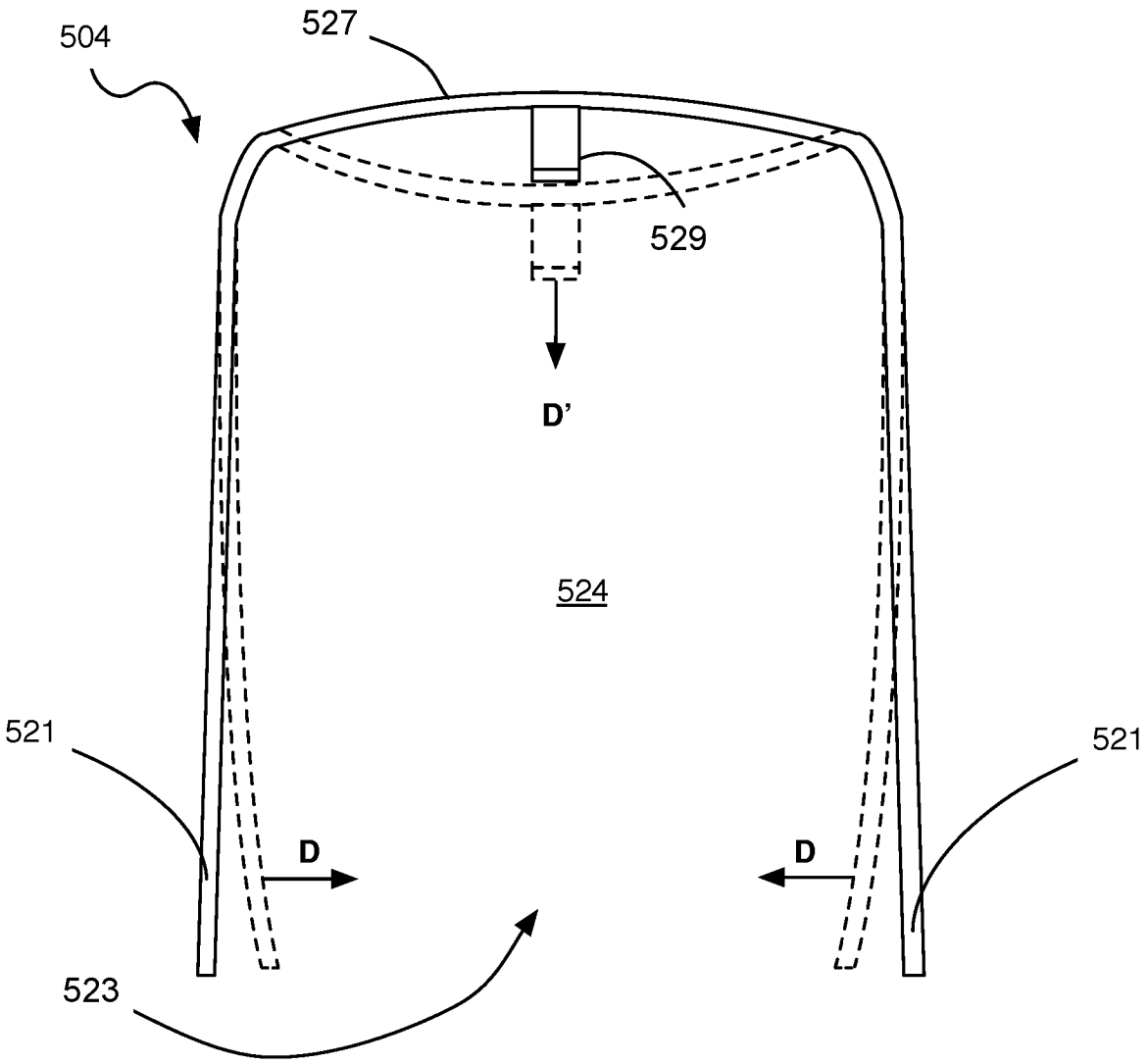
FIG. 17C depicts a cross-section view of the sleeve of FIGS. 17A and 17B.

FIGS. 17A, 17B and 17C show an example system 500 for making a craft in accordance with another embodiment. FIG. 17A is an exploded view of the system 500 and FIG. 17B shows the system 500 in an assembled configuration. The system 500 is generally similar to that depicted in FIGS. 1A and 1B, and like elements are assigned like numerals. The system 500 includes a core 102 and a sleeve 504. The core 102 includes a molding portion 106 and, in some embodiments, a graspable portion 108 configured to facilitate the removal of the core 102 from the sleeve 504. The graspable portion 108 is configured to be grasped by a user, and may be, for example, a flange, or one or more tabs that extend radially outward from the molding portion 106 of the core 102.

The core 102 provides a supporting structure for the sleeve 504 when the sleeve 504 is placed over the molding portion 104, as shown in FIG. 17B.

The sleeve 504 includes an exterior surface 522 and defines an interior space 524. The sleeve 504 has a sidewall 521 and a central body 527 defining an open end 523 (FIG. 4) and is configured to slip over and at least partially cover the molding portion 106 of the core 102 so as to receive the molding portion 106 in the interior space. For example, the crafting surface 103 may face generally upwards and the open end 523 of the sleeve 504 face generally downwards when the sleeve 504 is on the molding portion 106 and the core 102 is on the crafting surface 103.

The sleeve 504 has a collapsible portion that is collapsible towards the interior space 524. In this embodiment, the collapsible portion is at least a portion of the sidewall 521 of the sleeve 504. The sidewall 521 is continuous and undivided into leaf portions in this scenario. Instead, the collapsible portion in this embodiment is a portion of the sidewall 521 that is sufficiently flexible to permit articulation interiorly thereof. For example, the sleeve 504 can be made of a material that is sufficiently flexible and non-stick (for example, thermoplastic rubber, or a silicone material) and of a thickness, such that the sidewall 521 can be peeled inwardly towards the interior space 524 away from a molding material, and the molding material does not adhere to the sleeve 504.

The thickness of the sleeve can be continuous or varied to define the collapsible portion(s). In some scenarios, it may be desirable to construct the sleeve of a material and thickness so that the entire sleeve is collapsible towards the interior space.

It may be desirable to construct the sleeve with one or more graspable interior features to facilitate peeling or removal of the sleeve from the molding material. For example, one or more tabs can be located along the inside surface of the sidewall of the sleeve or its central body to enable a person to grasp and pull the sleeve away from the molding material. The core may be constructed to receive the tabs to ensure that the exterior surface of the sleeve provides a desired shape when the core is inserted into the sleeve.

The sleeve 504 is shown in FIG. 7C having a tab 529 on an interior surface of its body 527. When the tab 529 is pulled towards the interior space 524 (shown as a direction D'), the body 527 is pulled away from a molding material formed around its exterior surface 522. Additionally, the sidewalls 521 can be peeled away from the molding material in directions D towards the interior space 524.

In addition, one or more discontinuities in the sleeve can be employed to facilitate collapsing of the sleeve and its removal from the molding material. In addition, such discontinuities can inhibit the formation of a vacuum between the sleeve and the molding material that may hinder the sleeve's removal from the molding material. The discontinuities can be slits or gaps that do or do not extend to an edge of the sleeve, apertures to prevent the formation of a vacuum, lines of perforations to facilitate folding and the like.

Persons skilled in the art will appreciate that there are yet more alternative implementations and modifications possible, and that the above examples are only illustrations of one or more implementations. The scope, therefore, is only to be limited by the claims appended hereto.

The invention claimed is:

1. A method of making a craft, comprising:

providing a core, the core including a molding portion;

placing a sleeve over the molding portion, the sleeve being configured to be releasable from the core and being shaped such that the molding portion is entirely recessed from an exterior surface of the sleeve when the sleeve is placed over the molding portion;

applying a portion of molding material over the sleeve such that the sleeve completely separates the molding material from the molding portion;

after the applying step, shaping the portion of molding material on the sleeve to create a craft;

at least partially drying the craft;

releasing the core from the sleeve, without removing the sleeve from the craft; and releasing the sleeve from the craft.

2. The method of claim 1, further comprising:

applying a hydrating fluid to the portion of molding material during at least one of the applying and shaping steps.

3. The method of claim 1, further comprising:

placing the core on a crafting surface that is a surface of a turntable configured to rotate about an axis of rotation.

4. The method of claim 3, wherein shaping the portion of molding material on the sleeve includes rotating the turntable about the axis of rotation.

5. The method of claim 4, wherein a motor is operatively connected to the turntable and rotating the turntable about the axis of rotation includes actuating the motor.

6. The method of claim 1, wherein the at least partially drying step includes air-drying the craft on the sleeve.

7. The method of claim 3, wherein the crafting surface faces generally upwards and the sleeve has an open end that faces generally downwards when the sleeve is on the molding portion and when the core is on the crafting surface.

8. The method of claim 1, wherein the sleeve defines an interior space and wherein the releasing of the sleeve from the craft comprises collapsing a collapsible portion of the sleeve towards the interior space.

9. The method of claim 8, wherein the collapsing comprises articulating at least one leaf portion of the core towards the interior space.

10. The method of claim 8, wherein the collapsing comprises articulating a flexible sidewall portion towards the interior space.

* * * * *